US008374533B2

(12) United States Patent
Higgins et al.

(10) Patent No.: US 8,374,533 B2
(45) Date of Patent: Feb. 12, 2013

(54) METHOD TO AUTOMATE A TRANSFER ASSIST BLADE DEVICE TIMING ADJUSTMENT

(75) Inventors: Thomas Edward Higgins, Fairport, NY (US); Kenneth Wayne Luff, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 280 days.

(21) Appl. No.: 12/913,051

(22) Filed: Oct. 27, 2010

(65) Prior Publication Data

US 2012/0106992 A1 May 3, 2012

(51) Int. Cl.
*G03G 15/16* (2006.01)

(52) U.S. Cl. ..... 399/316

(58) Field of Classification Search ..... 399/31, 399/66, 316, 317

See application file for complete search history.

(56) References Cited

U.S. PATENT DOCUMENTS 5,247,335 A * 9/1993 Smith et al. ..... 399/316
6,845,224 B1 1/2005 Gross et al.
7,257,359 B2 * 8/2007 Soures et al. ..... 399/316
8,238,769 B2 * 8/2012 Soures ..... 399/31
2005/0025536 A1 2/2005 Gross et al.
2007/0048034 A1 3/2007 Soures et al.
2012/0237239 A1 * 9/2012 Falvo et al. ..... 399/66

OTHER PUBLICATIONS

GB Search Report, British Application No. GB1118069.2; mailed Feb. 16, 2012, Dated Feb. 15, 2012, Intellectual Property Office of Great Britain.

* cited by examiner

*Primary Examiner* — Robert Beatty
(74) *Attorney, Agent, or Firm* — Fay Sharpe LLP

(57) ABSTRACT

When calibrating a transfer assist blade (TAB) in a printer, toner patches are formed on a photoreceptor belt in the printer at locations between sheets of paper. The TAB is partially deployed between paper sheets to pick up toner, and then deployed normally or with a delay to mark the back sides of the sheets. A processor evaluates distances between TAB touchdown and liftoff points and leading and trailing edges of the sheets, and calibrates the TAB to optimize the TAB timing. Additionally, test prints can be generated, each having slightly varied TAB calibration settings that are stored in a non-volatile memory (NVM) table. A user enters an identification number for a test print with the best calibration settings. The processor looks up calibration settings corresponding to the entered identification number and moves NVM settings from the table into operational locations in the system NVM to calibrate the printer.

18 Claims, 9 Drawing Sheets

METHOD TO AUTOMATE A TRANSFER ASSIST BLADE DEVICE TIMING ADJUSTMENT

TECHNICAL FIELD

The present exemplary embodiments broadly relate to transfer assist blade (TAB) calibration for a marking device or printer. However, it is to be appreciated that the present exemplary embodiments are also amenable to other devices and other applications.

BACKGROUND

The process of transferring charged toner particles from an image bearing member marking device (e.g. photoreceptor) to an image support substrate (e.g., sheet) involves overcoming cohesive forces holding the toner particles to the image bearing member. The interface between the photoreceptor surface and image support substrate is not always optimal. Thus, problems may be caused in the transfer process when spaces or gaps exist between the developed image and the image support substrate. A critical aspect of the transfer process is focused on the application and maintenance of high intensity electrostatic fields in the transfer region for overcoming the cohesive forces acting on the toner particles as they rest on the photoreceptive member. Careful control of these electrostatic fields and other forces is required to induce the physical detachment and transfer-over of the charged toner particles without scattering or smearing the developer material. Mechanical devices that force the image support substrate into intimate and substantially uniform contact with the image bearing surface have been incorporated into transfer systems. Various contact blade arrangements have been proposed for sweeping the backside of the image support substrate, with a specified force, at the entrance to the transfer region.

Xerographic systems use a Transfer Assist Blade (TAB) to flatten print media onto the photoreceptor to ensure uniform transfer of the toner to the sheet. With a moving process the TAB must be timed to touchdown and lift off respectively as close to the lead edge and trail edge of the sheet as possible in order to maximize the portion of the sheet having uniform toner transfer. TAB timing is affected by variations in process velocity, mechanical geometry, software iteration delays, image-to-sheet registration and sheet thickness, cut size and shrinkage. At present TAB timing is calibrated for the fleet based on observations with high-speed video on sample systems. In order to ensure that the TAB does not touch the photoreceptor (which would be harmful) the reference timing is set conservatively, accounting for these variations. Individual system calibration in the field is impractical because of the requirement for high-speed video.

One methodology for adjusting the transfer assist blade timing requires a time consuming manual process wherein the user is required to make trial-and-error input to the system, with visual observations of the result. This is a frequent adjustment which is required when the transfer assist assembly, or its replaceable blade element becomes worn or damaged, as it often does due to constantly coming into contact with moving print throughput (paper). The user is required to manually record specified non-volatile memory (NVM) data then change the NVM settings to cause the trail edge timing of the transfer assist blade to be delayed. This causes the blade to contact the photoreceptor and acquire a small amount of toner placed on the photoreceptor by the system. The user repeatedly checks for marks on the lead and trail edges of the back side of a test print to determine that the timing adjustment is as specified for the product. The user makes a test print, evaluates the print, makes a data entry to the system, and makes another test print, thus beginning a cycle of events concluding when the result specified for the product is obtained. The user must then return the trail edge timing to the original values, manually recorded earlier in the set up. The number of user interactions is high and time consuming. The time to perform this exercise represents considerable cost to the company measured in technical service hours.

There is an unmet need in the art for automated TAB timing calibration systems and methods that overcome the above-mentioned deficiencies and others.

BRIEF DESCRIPTION

In one aspect, a method of automating a transfer assist blade (TAB) timing calibration comprises printing an image-on-sheet (IOS) registration pattern on both sides of N sheets of paper, where N is an integer, developing toner patches on a photoreceptor belt surface between sheets passing over the photoreceptor belt surface, and engaging the TAB lightly on a toner patch to collect toner on the tip of the TAB. The method further comprises performing lead edge TAB timing calibration engaging the TAB normally on the sheets to deposit toner on the back side thereof, and performing trail edge TAB timing calibration by delaying TAB engagement for a predetermined period, engaging the TAB normally upon expiration of the predetermined period to deposit toner on the back side of the sheets, and disengaging the TAB as soon as the TAB is fully engaged.

In another aspect, a system that facilitates automating a transfer assist blade (TAB) timing calibration comprises a printer that prints an image-on-sheet (IOS) registration pattern on both sides of N sheets of paper, where N is an integer, and generates toner patches on a photoreceptor belt surface, between sheets passing over the photoreceptor belt surface. The system further includes a processor that executes computer-executable instructions for engaging the TAB lightly on a toner patch to collect toner on the tip of the TAB, performing lead edge TAB timing calibration engaging the TAB normally on the sheets to deposit toner on the back side thereof, and performing trail edge TAB timing calibration by delaying TAB engagement for a predetermined period, engaging the TAB normally upon expiration of the predetermined period to deposit toner on the back side of the sheets, and disengaging the TAB as soon as the TAB is fully engaged.

In yet another aspect, a method of calibrating a transfer assist blade (TAB) in a printer comprises generating a plurality of test prints, each having a different TAB calibration setting, building a non-volatile memory (NVM) table comprising NVM data for each of the TAB calibrations, and storing user input regarding a user-identified test print having a correct calibration, the user input including an identification number for the identified test print. The method further comprises accessing the NVM data table and reading NVM data used to generate the identified test print, storing the NVM data into operational NVM locations for future printer use, and deleting the NVM table once the NVM data for the identified test print has been stored to the operational NVM locations.

DETAILED DESCRIPTION

The systems and methods described herein can be utilized to calibrate individual transfer assist blade (TAB) systems in the field. Calibration may be required after certain maintenance activities such as replacing a component or performing an adjustment. A special job is programmed in the system, in which toner is deposited in the form of a 'patch' at a location where there is no sheet, wherein the TAB partially deploys to pick up patch toner on the tip of the blade but without actually putting pressure on the photoreceptor, and then subsequently the TAB operates as usual on a sheet so as to leave a mark indicating exactly where it touched down. Timing settings can then be adjusted to move the touchdown point closer to the lead edge of the sheet. A similar operation can be performed for the trail edge. Compensation is made for mechanical operation to determine the expected liftoff point relative to the measured trail edge touchdown point.

Figure 1:
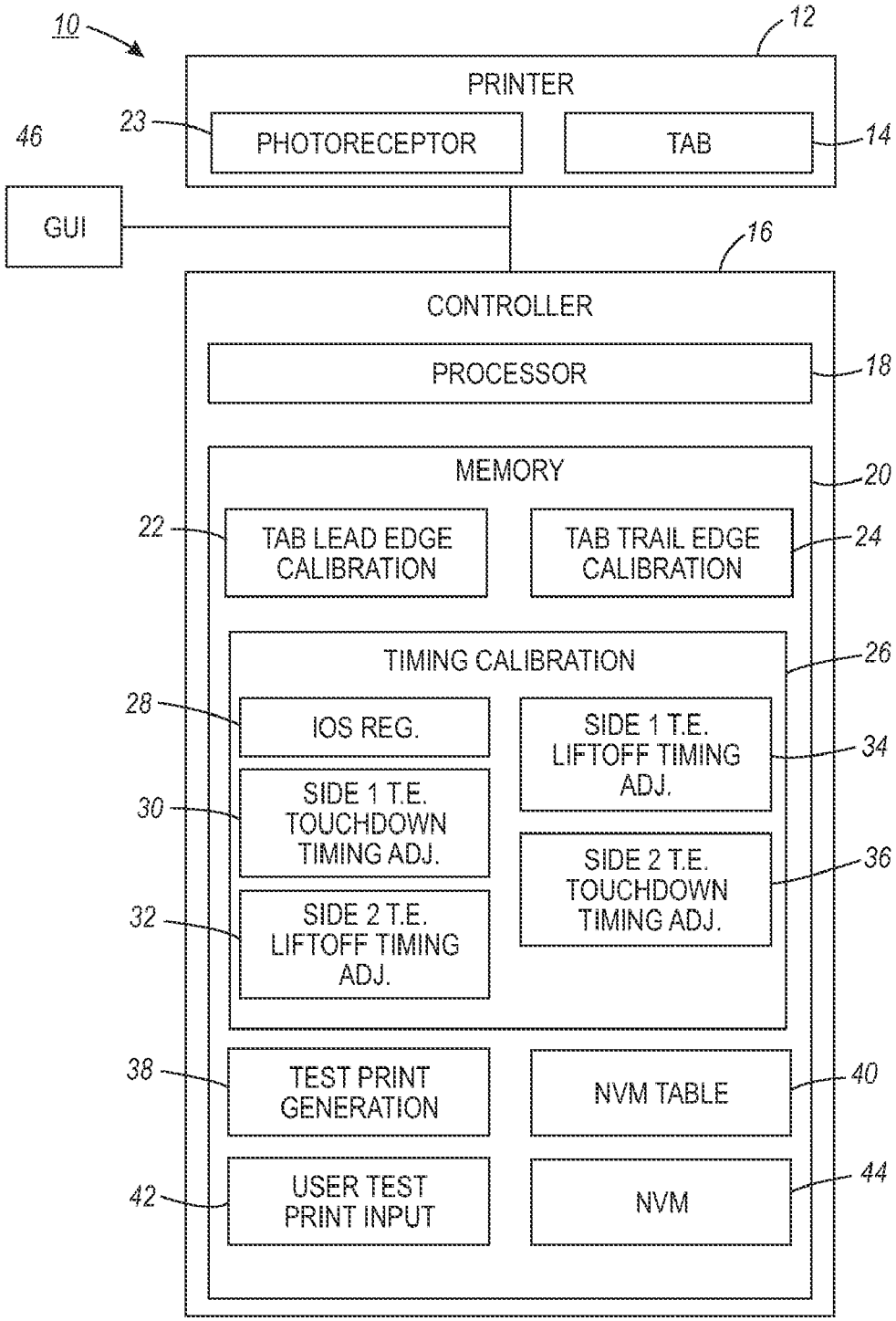
FIG. 1 illustrates a system that facilitates employing two calibration functions that operate to place marks near the lead edge or trail edge of sheets in process, and a executing a procedure consisting of engaging the print jobs, measuring the marks, and making adjustments to TAB timing parameters.

FIG. 1 illustrates a system 10 that facilitates employing two calibration functions that operate to place marks near the lead edge or trail edge of sheets in process, and a executing a procedure consisting of engaging the print jobs, measuring the marks, and making adjustments to TAB timing parameters. The following description relates to a system in which sheets are registered on the lead edge (LE) of side 1, and trail edge (TE) of side 2. However, it will be appreciated that the described systems and methods are adaptable to systems that have different registration methods and other unique attributes.

The system 10 includes a printer 12 with a TAB module or assembly 14. The printer 12 is coupled to a controller 16 that includes a processor 18 that executes, and a memory 20 (e.g., a computer readable medium) that stores, computer executable instructions (e.g., executables, routines, programs, algorithms, etc.) for performing the various tasks, functions, routines, procedures, etc., described herein. For instance, the memory 20 stores a TAB lead edge calibration module or routine 22 that, when executed by the processor 18, causes an image-on-sheet (IOS) pattern to be printed on both sides of at least N sheets, where N is an integer (e.g., 40, 50, etc.), to ensure proper sheet registration for the last approximately N/2 sheets. Toner patches are developed on a photoreceptor 23 in between the printed images, and the TAB is briefly and lightly engaged, such that it briefly touches a toner patch on the photoreceptor 23 and picks up toner on the TAB tip. The routine 22 then causes the TAB to be engaged normally so as to deposit the toner picked up by the TAB tip onto the paper sheet.

The memory 20 also stores a TAB trail edge calibration module or routine 24 that, when executed by the processor 18, causes an IOS pattern to be printed on both sides of at least N sheets, where N is an integer (e.g., 45, 60, etc.), to ensure proper sheet registration for the last approximately N/2 sheets. Toner patches are developed on the photoreceptor 23 in between the printed images, and the TAB is briefly and lightly engaged, such that it briefly touches the toner patch on the photoreceptor 23 and picks up toner on the TAB tip. The module or routine 24 delays TAB engagement for a predetermined time period, and causes the TAB to touch down upon expiration of the predetermined time period. The module or routine 24 then causes the TAB to disengage as soon as it has fully engaged.

The memory 20 further stores a TAB timing calibration module or routine 26, that, when executed by the processor 18, initiates several subroutines for calibrating TAB touchdown and liftoff timing. The TAB timing calibration module 26 includes an IOS registration module or routine 28 that performs IOS registration. The timing calibration module 26 further includes a TAB touchdown (engagement) timing adjustment module 30 for lead edge of a first side of the sheet(s) (side 1), a TAB liftoff timing adjustment module 32 for a trail edge on side 2 of the sheet(s), a TAB liftoff timing adjustment module 34 for the trail edge on side 1 of the sheet(s), and a TAB touchdown (engagement) timing adjustment module 36 for the lead edge of side 2 of the sheet(s). The TAB timing calibration module or routine 26 and related sub-routines are described in greater detail with regard to FIGS. 4-8.

Also stored in the memory 20 and executed by the processor 18 are a test print generation module 38, a non-volatile memory (NVM) table 40, user test print input 42 received from a user, and the NVM 44 itself, which are employed to alter non-volatile memory (NVM) data to adjust edge timing for the TAB 14 and cause the TAB to pick up toner from a toner patch placed on the photoreceptor belt 23 for TAB calibration. That is, the NVM data 44 is automatically altered, thereby causing the edge timing of the TAB 14 to be delayed, allowing the blade to contact the photoreceptor 23 and to acquire a small amount of toner placed on the photoreceptor 23 by the system. The printer 12 generates a series of test prints with a system generated image on the front side identifying the prints 1–n, where n is an integer. Each print represents a slightly different set point adjustment of the transfer blade timing. The processor builds the NVM table 40 containing the data used to create the TAB timing of each test print. In one example, the NVM table 40 is stored in a buffer. The back side of each print shows a toner mark where the transfer blade has come into contact with the sheet and deposited toner picked up from the toner patches positioned between the sheets on the photoreceptor belt. User input is received regarding a user-selected or identified sheet that demonstrates the correct adjustment, and a user-entered print number for the sheet. The user input may be received via a user interface screen or graphical user interface (GUI) 46. The processor accesses the NVM data table 40, and reads the data used to create the user-identified print sheet. The NVM data associated with the user-identified print sheet is stored in the operational NVM locations (i.e., locations that govern TAB timing) in the NVM 44. The NVM table created for the test print run may be deleted from the buffer at this point because it is no longer needed.

Figure 2:
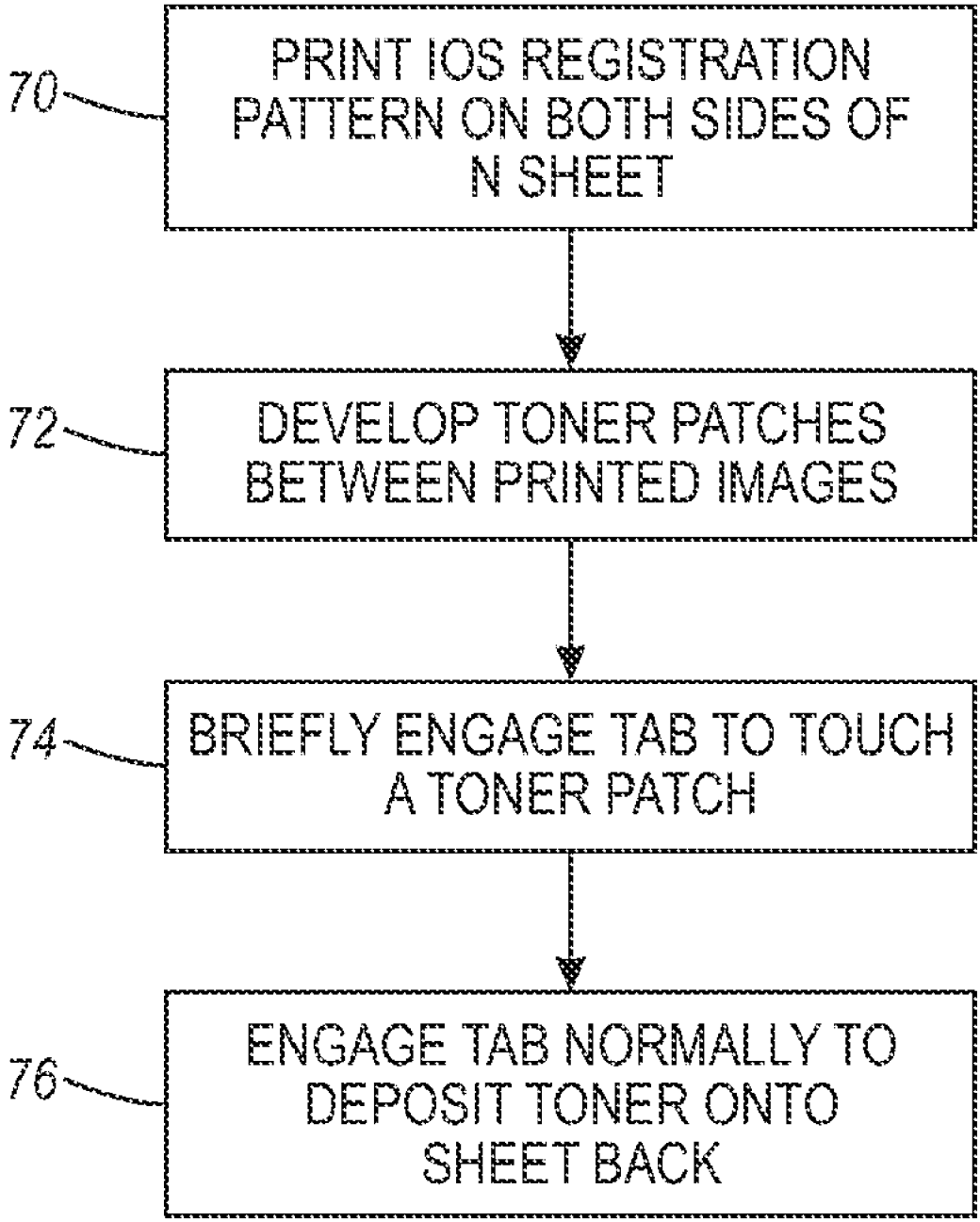
FIG. 2 illustrates a method for TAB lead edge calibration.

FIG. 2 illustrates a method for TAB lead edge calibration, such as is performed by the TAB lead edge calibration module 22 of FIG. 1. At 70, an image-on-IOS pattern is printed on both sides of at least N, where N is an integer (e.g., 40, 50, etc.) sheets to ensure proper sheet registration for the last approximately N/2 sheets. At 72, toner patches are developed on the photoreceptor in between the printed images. At 74, the Tab is briefly and lightly engaged, such that it briefly touches the toner patch on the photoreceptor and picks up toner on the TAB tip. At 76, the TAB is engaged normally so as to deposit the toner picked up by the TAB tip onto the paper.

Figure 3:
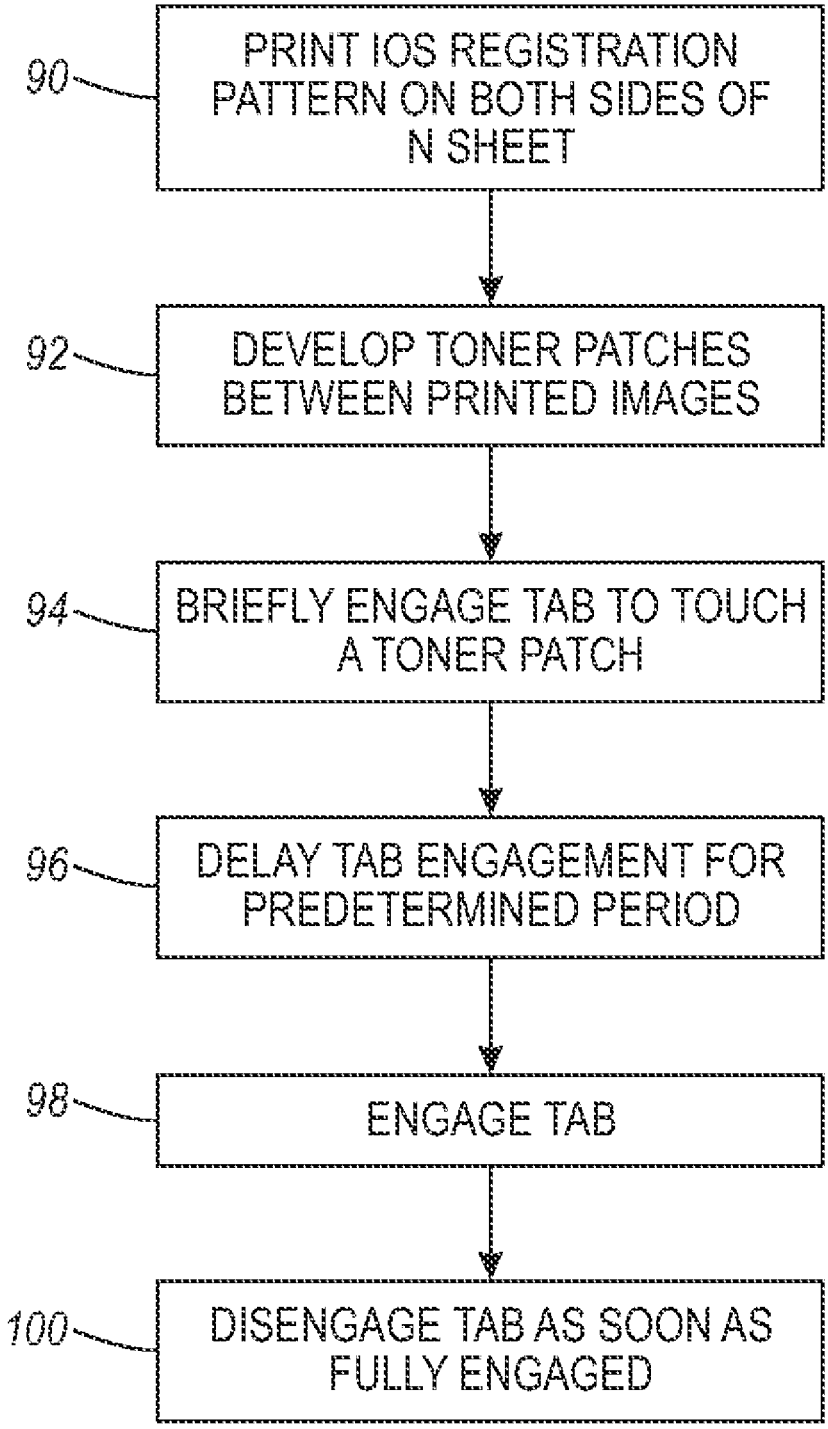
FIG. 3 illustrates a method for TAB trail edge calibration.

FIG. 3 illustrates a method for TAB trail edge calibration, such as is performed by the TAB trail edge calibration module 24 of FIG. 1. At 90, an IOS pattern is printed on both sides of at least N, where N is an integer (e.g., 45, 60, etc.) sheets to ensure proper sheet registration for the last approximately N/2 sheets. At 92, toner patches are developed on the photoreceptor in between the printed images. At 94, the TAB is briefly and lightly engaged, such that it briefly touches the toner patch on the photoreceptor and picks up toner on the TAB tip. At 96, TAB engagement is delayed for a predetermined time period. For instance, TAB engagement may be delayed such that:

Calibration engage time=normal engage time+normal trail edge delay (for the side in process)−TAB Trail Edge Calibration Lead Time, where TAB Trail Edge Calibration Lead Time is determined as follows. Let "touch time" and "liftoff time" be the duration of the TAB operation to just touch or just lift off the paper while respectively engaging or disengaging. Let TAB Trail Edge Cal Lead Time="touch time"−"liftoff time". Then, at 98, with the above delayed engagement, the TAB touches down at the delayed time, such that:

[normal engage time+normal trail edge delay+"liftoff time"−"touch time"]+"touch time".

That is, the TAB will touch down at the expected liftoff time, and will leave a mark whose leading edge is at the normal liftoff position. At 100, the TAB is disengaged as soon as it has fully engaged. It will be noted that, when running either the TAB lead edge calibration of FIG. 2 or the TAB trail edge calibration of FIG. 3, the TAB touchdown and liftoff marks are deposited on the opposite side of the sheet from the side being printed on and calibrated for.

Figure 4:
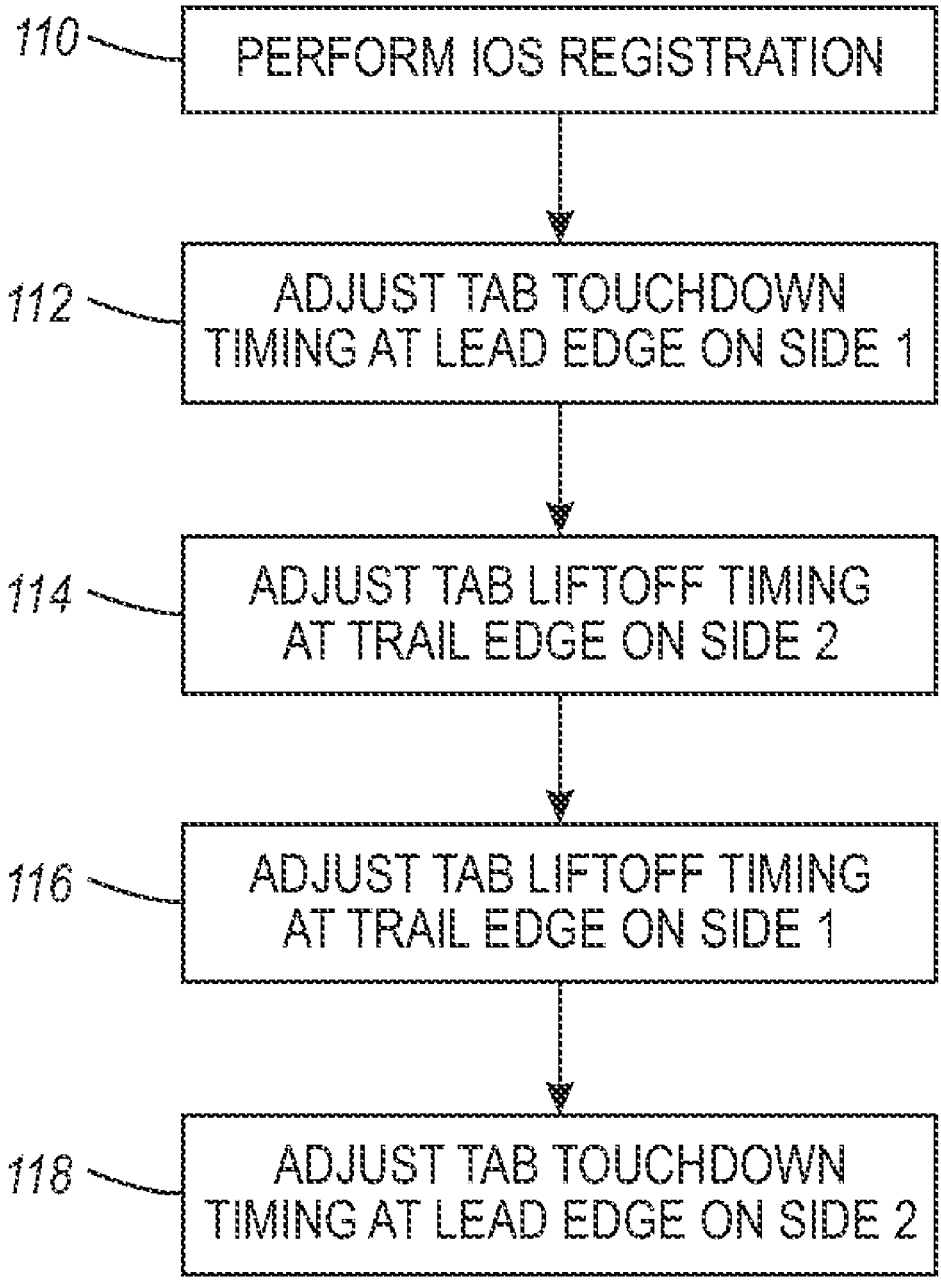
FIG. 4 illustrates a method for TAB timing calibration.

FIG. 4 illustrates a method for TAB timing calibration, such as is performed by the TAB timing calibration module 26 of FIG. 1. At 110, IOS registration is performed. At 112, TAB touchdown (engagement) timing is adjusted for the lead edge of a first side of the sheet(s) (side 1). At 114, TAB liftoff timing is adjusted for the trail edge on side 2 of the sheet(s). At 116, TAB liftoff timing is adjusted for the trail edge on side 1 of the sheet(s). At 118, TAB touchdown (engagement) timing is adjusted for the lead edge of side 2 of the sheet(s). Acts 112, 114, 116, and 118 are described in greater detail with regard to FIGS. 5-8.

Figure 5:
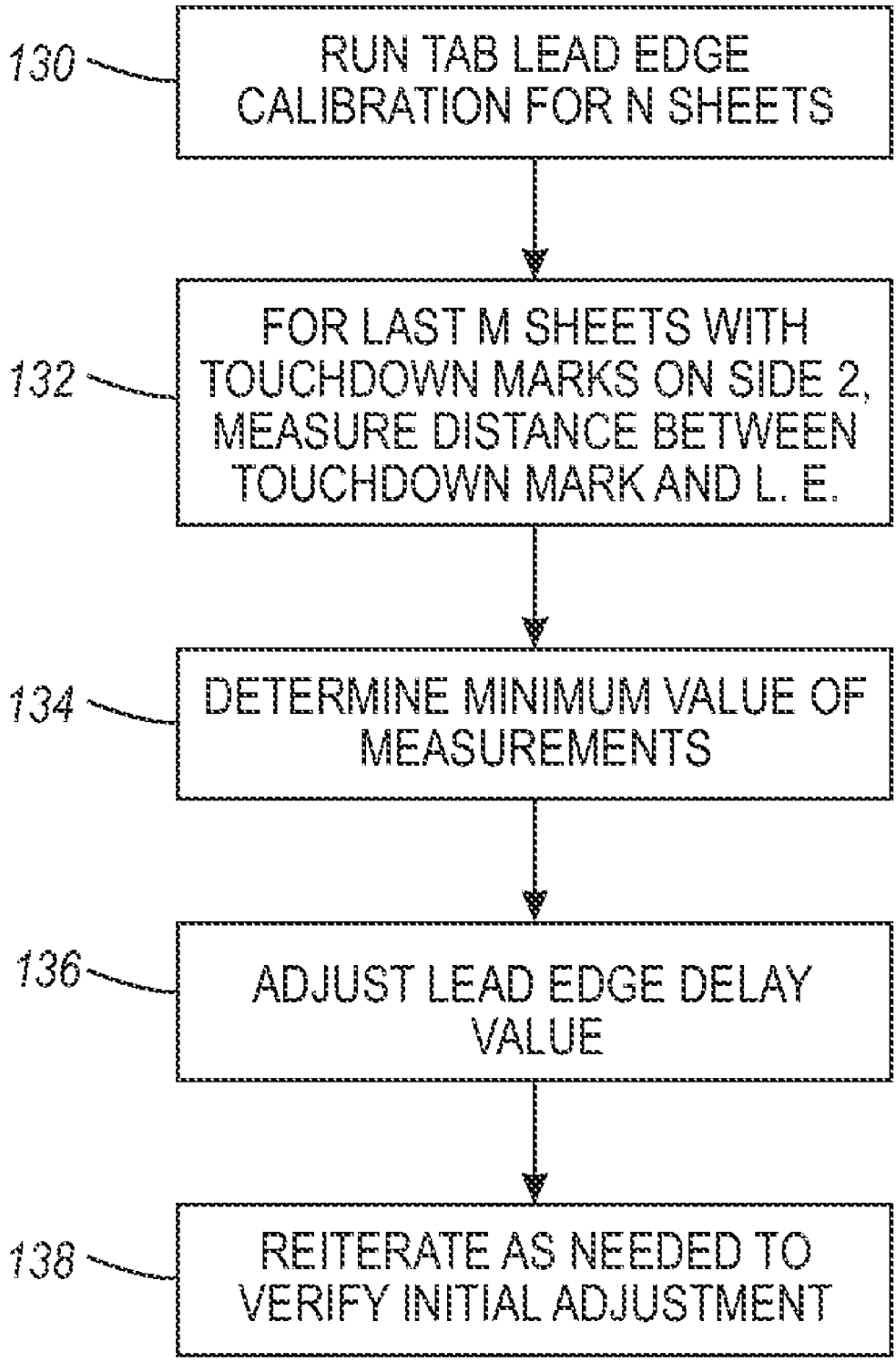
FIG. 5 illustrates a method of adjusting TAB touchdown timing at the lead edge on side 1 of the sheet(s).

FIG. 5 illustrates a method of adjusting TAB touchdown timing at the lead edge on side 1 of the sheet(s), such as is described in FIG. 4 at 112. In one example, the lead edge is the registered edge on Side 1. Adjusting the lead edge on Side 1 timing is done first because both edges on both sides are dependent on this setting. At 130, TAB lead edge calibration is performed for the specified number of sheets, as described with regard to FIG. 2. At 132, for the last M sheets, where M is an integer (e.g., 10), which have TAB touchdown marks on side 2, a distance (e.g., in mm) is measured between the TAB touchdown mark and the sheet lead edge. At 134 a minimum value of this set of measurements is determined (e.g., across all M sheets). It is desirable that the "measured minimum" be as small as possible but not less than a predetermined "constraint" or threshold value. Therefore, at 136, the lead edge delay value, which has a given units resolution, is adjusted as follows:

TAB Lead Edge Delay(new)=TAB Lead Edge Delay (initial)−Delay resolution*INTEGER[((measured minimum−constraint)/process velocity)/Delay resolution], where the delay resolution is the minimum unit of time by which the TAB actuation controller can control actuation start time, e.g. 1.0 millisecond, and where the INTEGER function is defined as the integer equal to or nearest and more negative than the argument. Process velocity is defined in terms of sheets per unit of time. A positive change in lead edge delay occurs if initially the measured minimum is less than the constraint (a threshold), which will move the touchdown away from the sheet lead edge. At 138, the method is iterated as needed to verify the initial adjustment.

Figure 6:
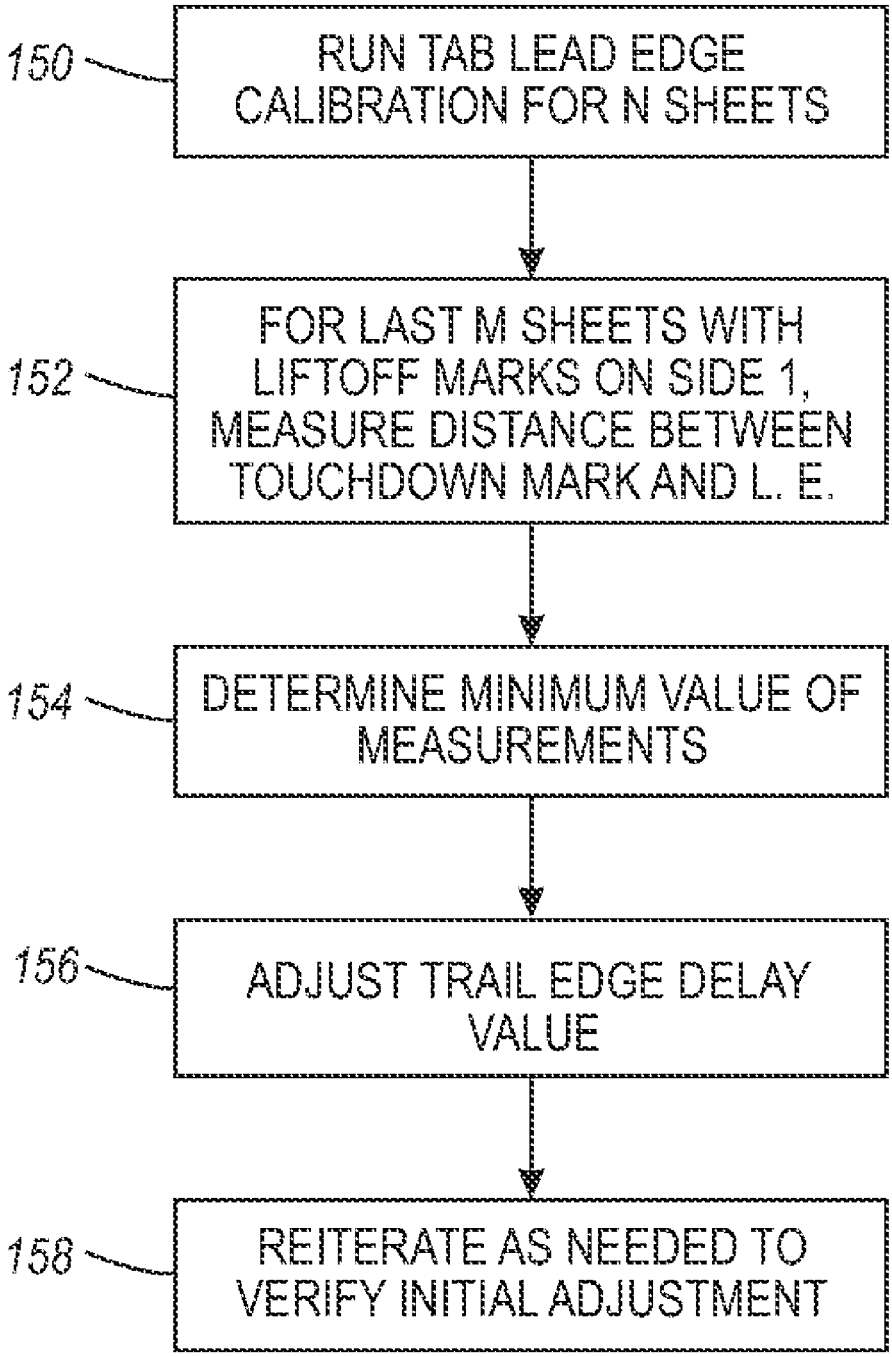
FIG. 6 illustrates a method of adjusting TAB liftoff timing at a trail edge of side 2 of the sheet(s).

FIG. 6 illustrates a method of adjusting TAB liftoff timing at a trailing edge of side 2 of the sheet(s), as described with regard to 114 of FIG. 4. In one example, the trail edge is the registered edge on Side 2, and the timing of this edge is relative to the lead edge timing, which is set beforehand. At 150, a TAB Trail Edge Calibration procedure is executed for the specified number of sheets, as described with regard to FIG. 3. At 152, for the last M sheets, where M is an integer (e.g., 10), which have TAB liftoff marks on side 1, a distance is measured (e.g., in mm) between the TAB touchdown mark and the sheet trail edge. At 154 a minimum value of this set of measurements is determined (e.g., across all M sheets). It is desirable that the "measured minimum" be as small as possible but not less than a predetermined constraint or threshold value. Therefore, at 156, the trail edge delay value, which has a given units resolution, is adjusted as follows:

TAB Trail Edge Delay(new)=TAB Trail Edge Delay (initial)+Delay resolution*INTEGER[((measured minimum−constraint)/process velocity)/Delay resolution].

A negative change in the TAB trail edge delay occurs if initially the measured minimum is less than the constraint or threshold. This will move the touchdown away from the sheet lead edge. At 158, the method is iterated as needed to verify the initial adjustment.

Figure 7:
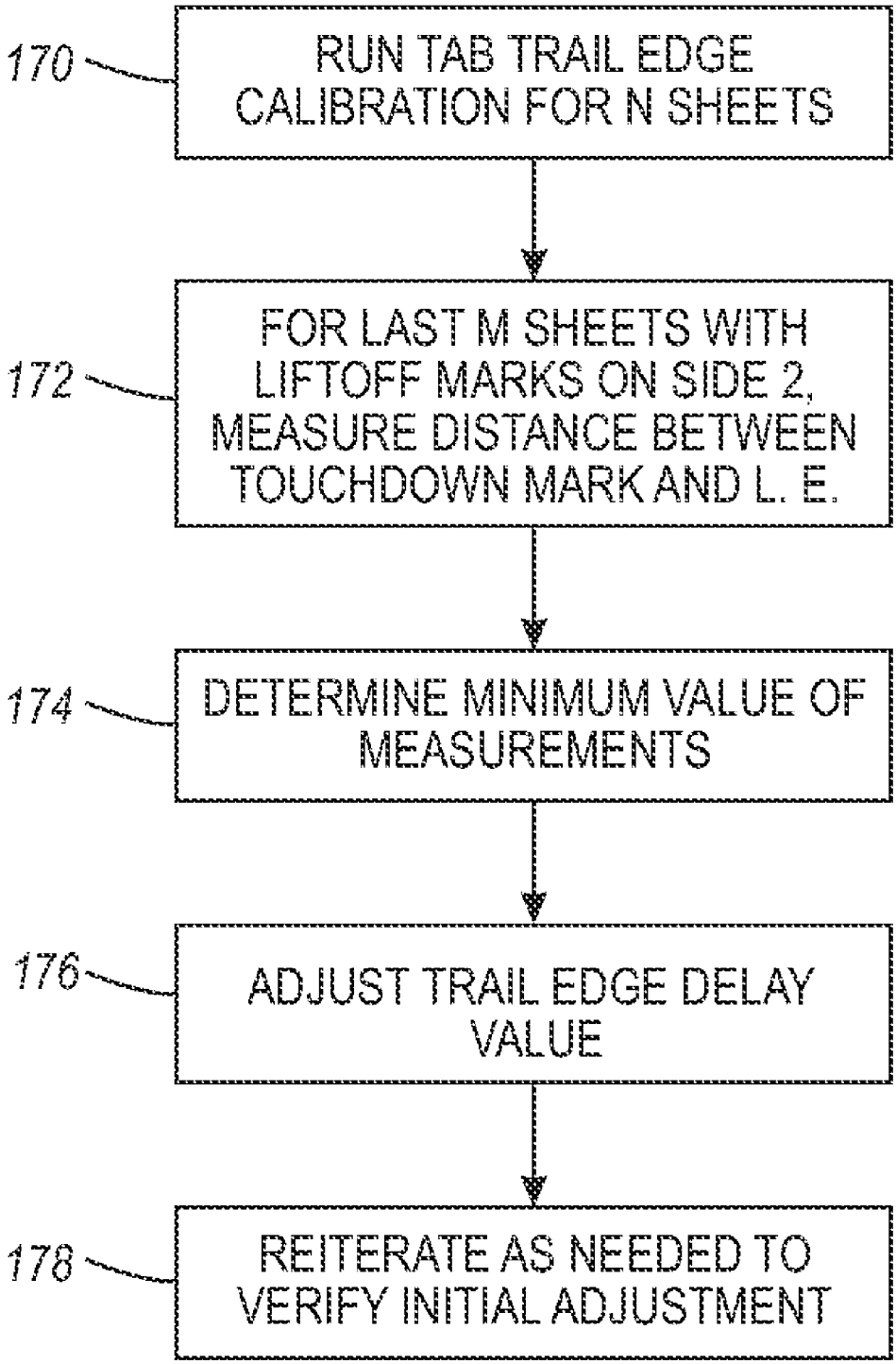
FIG. 7 illustrates a method of adjusting TAB liftoff timing on a trail edge of side 1 of the sheet(s).

FIG. 7 illustrates a method of adjusting TAB liftoff timing on a trail edge of side 1 of the sheet(s), as described with regard to 116 of FIG. 4. In one example, the trail edge is the unregistered edge on Side 1. The timing of this edge is affected by timing of the registered trail edge on side 2, which is done beforehand. A timing adjustment parameter, e.g., "Sheet OffCut Delay," is provided to allow independent adjustment of side 1 trail edge (after the two registered edge timings have been set) due primarily to sheet size and velocity variation, where engagement duration=sheet length/velocity. The constraint or threshold distance specified for this step should be larger than that for the registered edge to accommodate the larger variation on this edge due to variation in sheet cut size. Additional accommodation may be employed for a market with a different tolerance standard for cut sheet, or for a customer who cuts stock in-house.

At 170, a TAB trail edge calibration procedure is executed for the specified number of sheets, as described with regard to FIG. 3. At 172, for the last M sheets, where M is an integer (e.g., 10), which have TAB liftoff marks on side 2, a distance is measured (e.g., in mm) between the TAB touchdown mark and the sheet trail edge. At 174 a minimum value of this set of measurements is determined (e.g., across all M sheets). It is desirable that the "measured minimum" be as small as possible but not less than a predetermined constraint or threshold value. Therefore, at 176, the trail edge delay value, which has a given units resolution, is adjusted as follows:

TAB Sheet OffCut Delay(new)=TAB Sheet OffCut Delay(initial)+Delay resolution*INTEGER [((measured minimum−constraint)/process velocity)/Delay resolution].

A negative change in the TAB Sheet OffCut Delay occurs if initially the measured minimum is less than the constraint or threshold value. The negative change moves the touchdown away from the sheet lead edge. At 178, the method is iterated as needed to verify the initial adjustment.

Figure 8:
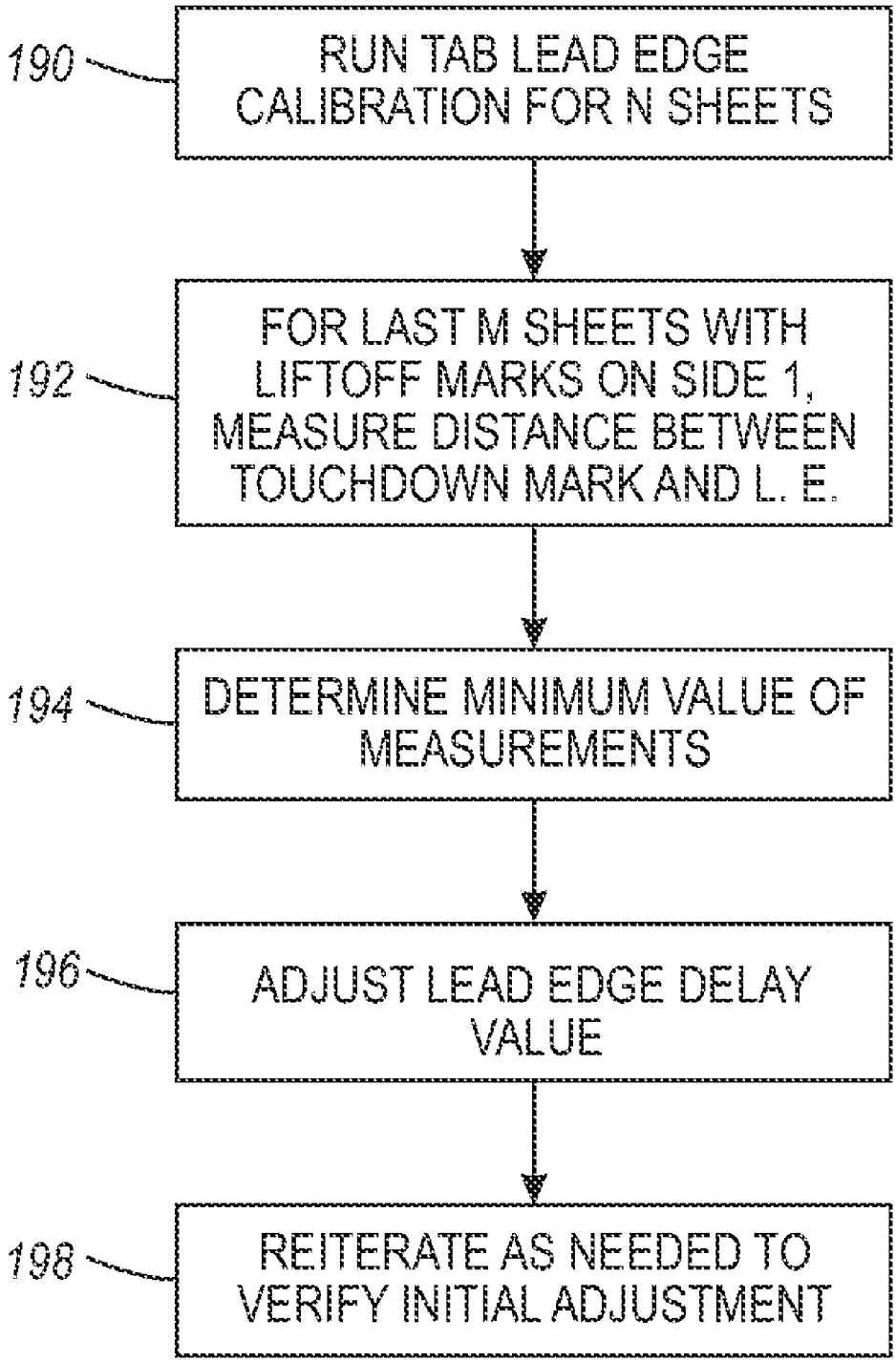
FIG. 8 illustrates a method of adjusting TAB touchdown timing at the lead edge on side 2 of the sheet(s).

FIG. 8 illustrates a method of adjusting TAB touchdown timing at the lead edge on side 2 of the sheet(s), such as is described in FIG. 4 at 118. In one example, the lead edge is the unregistered edge on Side 2. The timing of this edge is affected by sheet cut size, so the timing for the unregistered side 1 trail edge is adjusted beforehand. A timing adjustment parameter, e.g. "Side 2 Lead Edge Delay," is provided to allow independent adjustment of side 2 lead edge (after the two registered edge and sheet cut-size timings have been set) due to post-fuser sheet shrinkage, which can vary from stock to stock.

At 190, TAB lead edge calibration is performed for the specified number of sheets, as described with regard to FIG. 2. At 192, for the last M sheets, where M is an integer (e.g., 10), which have TAB touchdown marks on side 1, a distance (e.g., in mm) is measured between the TAB touchdown mark and the sheet lead edge. At 194 a minimum value of this set of measurements is determined (e.g., across all M sheets). It is desirable that the "measured minimum" be as small as possible but not less than a predetermined "constraint" or threshold value. Therefore, at 196, the lead edge delay value, which has a given units resolution, is adjusted as follows:

TAB Second Side Lead Edge Delay(new)=TAB Second Side Lead Edge Delay(initial)−Delay resolution*INTEGER[((measured minimum−constraint)/process velocity)/Delay resolution].

A positive change in the TAB Second Side Lead Edge Delay occurs if initially the measured minimum is less than the constraint or threshold value. This has the effect of moving the touchdown away from the sheet lead edge on side 2 only. At 198, the method is iterated as needed to verify the initial adjustment.

In some scenarios, large variations in media thickness can impact timing. A TAB blade may touchdown earlier, and liftoff later, from a thick substrate compared to a thin one. In addition, variations in process velocity affect trail edge timing proportionately to sheet size. Since the TAB engage duration is equal to sheet length divided by process velocity, a given variation in process velocity will result in a greater variation in engage duration for a longer sheet than a shorter sheet. The systems and methods described herein can be applied to these distinct situations as needed. Furthermore, differential timing coefficients can be defined and used to compute timing offsets as a function of sheet thickness and length. The described systems and methods can be applied to an expected range of media (e.g., thicknesses, lengths, etc.) to determine the required timing offsets, and derive the differential timing coefficients.

Figure 9:
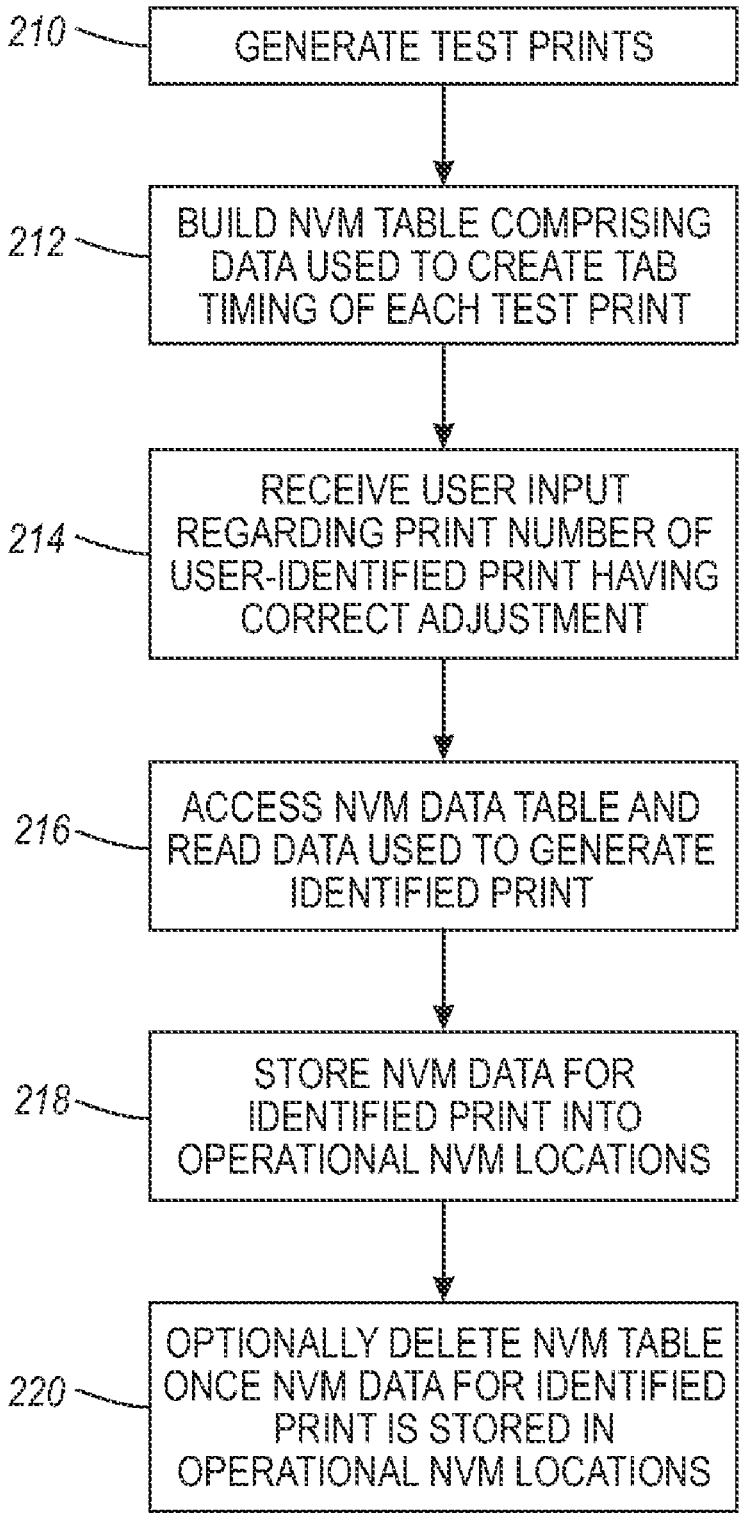
FIG. 9 illustrates a method of altering non-volatile memory (NVM) data to adjust edge timing for a TAB and cause the TAB to pick up toner from a toner patch placed on a photoreceptor belt for TAB calibration.

FIG. 9 illustrates a method of altering non-volatile memory (NVM) data to adjust edge timing for a TAB and cause the TAB to pick up toner from a toner patch placed on a photoreceptor belt for TAB calibration. That is, the method automatically alters NVM data, thereby causing the edge timing of the TAB to be delayed, allowing the blade to contact the photoreceptor and to acquire a small amount of toner placed on the photoreceptor by the system for the purposes of this routine. At 210, an operating system (e.g., the system of FIG. 1) produces a series of test prints with a system generated image on the front side identifying the prints 1–n. Each print represents a slightly different set point adjustment of the transfer blade timing. At 212, the operating system builds a NVM table containing the data used to create the TAB timing of each test print for the routine. The NVM table is stored in a buffer. The back side of each print will show a toner mark where the transfer blade has come into contact with the sheet and deposited toner picked up from the toner patches positioned between the sheets on the photoreceptor belt.

At 214, user input is received regarding a user-selected sheet that demonstrates the correct adjustment, and a user-entered print number for the sheet. The user input may be received via a user interface screen or graphical user interface (GUI). The operating system accesses the NVM data table, and reads the data used to create the user-identified print sheet, at 216. At 218, the NVM data associated with the user-identified print sheet is stored in the operational NVM locations (i.e., locations that govern TAB timing). At 220, the NVM table created for the test print run is deleted from the buffer because it is no longer needed. In this manner, test prints are created at approximately the rated speed of the printer, user interaction is reduced, and therefore the calibration routine is completed in far less time than is required for conventional calibration techniques, which often require trial-and-error calibration. The described method thus can be completed in under 5 minutes, as compared to up to thirty minutes for conventional techniques, because it does not require a user to manually access the NVM as does the existing practice.

According to an example in which the method of FIG. 9 is employed, the operating system will adjusts the timing of the TAB mechanism in order to move the contact point to a position known to be out of range to one side of the sheet. This is accomplished by saving current initial operational test (IOT) NVM data to an archival file (e.g., a table or the like), and altering NVM data locations assigned to control actuation points of the TAB, which are specified in the Machine Operating Description for the product. A degree or magnitude of alteration is established via product profile modeling. The operating system causes the marker or printing device to develop a small quantity of toner in the interdocument zone so that the TAB will pick up some of it on its tip for the purposes of making the adjustment. The TAB then deposits this toner at the point where its tip initially touches down on the subsequent sheet at a location determined by the position of the sheet relative to the TAB blade tip when TAB actuation starts. The operating system generates a print containing a system-generated image, e.g. TAB PRINT 1. The "canned" print image may stored on, and recalled from, the system disk, or stored as a pattern contained within video path components. The operating system adjusts the controlling NVM set point by an incremental value that causes a shift in TAB actuation start timing equal to approximately 1.0 millisecond relative to the print, and generates a second print containing a system generated image, e.g. TAB PRINT 2. An appropriate incremental value is established via product modeling. The operating system continues moving the controlling NVM set point by the incremental value to implement, for instance, a 1.0 millisecond timing shift until the timing shift has moved a total of, for example, 12.0 milliseconds. This incremental timing shift causes a sheet-to-sheet incremental shift in position of the deposited toner on the sheet corresponding to the incremental timing shift*sheet velocity, for instance 0.47 mm sheet-to-sheet position shift of deposited toner due to 1.0 milliseconds timing shift at 470 mm/second sheet velocity. An output tray of the printer will then contain 30 prints numbered TAB PRINT 1 through and including TAB PRINT 30, according to this example.

A user reviews the 30 test prints and chooses the print that demonstrates the timing position specified for the system. The user interface screen (FIG. 1) for this utility prompts the User to enter the identification number from the print that demonstrates the timing position specified for the system. The operating system locks in the NVM data that was used to create the timing position for the print number entered by the user. Once done, the buffer table containing the NVM data for the various prints is deleted from memory. If the routine is cancelled or a fault occurs during the operation, the operating system restores the original IOT.NVM data that was saved at the outset.

The exemplary embodiments have been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A method of automating a transfer assist blade (TAB) timing calibration, comprising:

printing an image-on-sheet (IOS) registration pattern on both sides of N sheets of paper, where N is an integer;

developing toner patches on a photoreceptor belt surface, between sheets passing over the photoreceptor belt surface;

engaging the TAB lightly on a toner patch to collect toner on the tip of the TAB;

performing lead edge TAB timing calibration by engaging the TAB normally on the sheets to deposit toner on the back side thereof;

performing trail edge TAB timing calibration by delaying TAB engagement for a predetermined period, engaging the TAB normally upon expiration of the predetermined period to deposit toner on the back side of the sheets, and disengaging the TAB as soon as the TAB is fully engaged.

2. The method according to claim 1, further comprising:

adjusting TAB touchdown timing at a lead edge of a first side of the sheets;

adjusting TAB liftoff timing at a trail edge of a second side of the sheets, the second side being the back side;

adjusting TAB liftoff timing at a trail edge of the first side of the sheets; and adjusting TAB touchdown timing at a lead edge of a second side of the sheets.

3. The method according to claim 2 wherein adjusting TAB touchdown timing at a lead edge of a first side of the sheets comprises:

executing a lead edge calibration routine for the N sheets;

for a last M sheets of the N sheets, where M is an integer less than N, the M sheets having TAB touchdown marks on the second sides thereof, measuring a distance between the touchdown mark and the lead edge of each of the M sheets;

determining a minimum value of the measurements;

adjusting a first side lead edge delay value as a function of the minimum value.

4. The method according to claim 3, wherein adjusting TAB liftoff timing at a trail edge of a second side of the sheets comprises:

executing a trail edge calibration routine for the N sheets;

for a last M sheets of the N sheets, where M is an integer less than N, the M sheets having TAB liftoff marks on the first sides thereof, measuring a distance between a touchdown mark and the lead edge of each of the M sheets;

determining a minimum value of the measurements;

adjusting a second side trail edge delay value as a function of the minimum value.

5. The method according to claim 4, wherein adjusting TAB liftoff timing at a trail edge of the first side of the sheets comprises:

executing a trail edge calibration routine for the N sheets;

for a last M sheets of the N sheets, where M is an integer less than N, the M sheets having TAB liftoff marks on the second sides thereof, measuring a distance between a touchdown mark and the trail edge of each of the M sheets;

determining a minimum value of the measurements;

adjusting a first side trail edge delay value as a function of the minimum value.

6. The method according to claim 5, wherein adjusting TAB touchdown timing at a lead edge of a second side of the sheets comprises:

executing a lead edge calibration routine for the N sheets;

for a last M sheets of the N sheets, where M is an integer less than N, the M sheets having TAB touchdown marks on the first sides thereof, measuring a distance between a touchdown mark and the lead edge of each of the M sheets;

determining a minimum value of the measurements;

adjusting a second side lead edge delay value as a function of the minimum value.

7. The method according to claim 3, wherein the first side lead edge delay value is defined as:

TAB Lead Edge Delay(new)=TAB Lead Edge Delay (initial)−Delay resolution*INTEGER[((measured minimum−constraint)/process velocity)/Delay resolution], where delay resolution is the minimum unit of time by which the actuation controller can control actuation start time, where the INTEGER function is defined as an integer equal to or nearest and more negative than the argument, where the constraint is a predetermined threshold distance value, and where process velocity is a function of sheets processed per unit of time.

8. The method according to claim 4, wherein the second side trail edge delay value is defined as:

TAB Trail Edge Delay(new)=TAB Trail Edge Delay (initial)+Delay resolution*INTEGER[((measured minimum−constraint)/process velocity)/Delay resolution], where delay resolution is the minimum unit of time by which the actuation controller can control actuation start time, where the INTEGER function is defined as an integer equal to or nearest and more negative than the argument, where the constraint is a predetermined threshold distance value, and where process velocity is a function of sheets processed per unit of time.

9. The method according to claim 5, wherein the first side trail edge delay value is defined as:

TAB Sheet OffCut Delay(new)=TAB Sheet OffCut Delay(initial)+Delay resolution*INTEGER [((measured minimum−constraint)/process velocity)/Delay resolution], where Sheet OffCut Delay is a timing adjustment value that allows independent adjustment of the first side trail edge, where delay resolution is the minimum unit of time by which the actuation controller can control actuation timing, where the INTEGER function is defined as an integer equal to or nearest and more negative than the argument, where the constraint is a predetermined threshold distance value, and where process velocity is a function of sheets processed per unit of time.

10. The method according to claim 6, wherein the second side lead edge delay value is defined as:

TAB Second Side Lead Edge Delay(new)=TAB Second Side Lead Edge Delay(initial)−Delay resolution*INTEGER[((measured minimum−constraint)/process velocity)/Delay resolution], where delay resolution is the minimum unit of time by which the actuation controller can control actuation timing, where the INTEGER function is defined as an integer equal to or nearest and more negative than the argument, where the constraint is a predetermined threshold distance value, and where process velocity is a function of sheets processed per unit of time.

11. A processor configured to perform the method according to claim 1.

12. A system that facilitates automating a transfer assist blade (TAB) timing calibration, comprising:

a printer that:

prints an image-on-sheet (IOS) registration pattern on both sides of N sheets of paper, where N is an integer; and generates toner patches on a photoreceptor belt surface, between sheets passing over the photoreceptor belt surface; and a processor that executes computer-executable instructions for:

engaging the TAB lightly on a toner patch to collect toner on the tip of the TAB;

performing lead edge TAB timing calibration by engaging the TAB normally on the sheets to deposit toner on the back side thereof;

performing trail edge TAB timing calibration by delaying TAB engagement for a predetermined period, engaging the TAB normally upon expiration of the predetermined period to deposit toner on the back side of the sheets, and disengaging the TAB as soon as the TAB is fully engaged.

13. The system according to claim 12, the instructions further comprising:

adjusting TAB touchdown timing at a lead edge of a first side of the sheets;

adjusting TAB liftoff timing at a trail edge of a second side of the sheets, the second side being the back side;

adjusting TAB liftoff timing at a trail edge of the first side of the sheets; and adjusting TAB touchdown timing at a lead edge of a second side of the sheets.

14. The system according to claim 13 wherein adjusting TAB touchdown timing at a lead edge of a first side of the sheets further comprises the processor executing computer-executable instructions for:

executing a lead edge calibration routine for the N sheets;

for a last M sheets of the N sheets, where M is an integer less than N, the M sheets having TAB touchdown marks on the second sides thereof, measuring a distance between the touchdown mark and the lead edge of each of the M sheets;

determining a minimum value of the measurements;

adjusting a first side lead edge delay value as a function of the minimum value.

15. The system according to claim 14, wherein adjusting TAB liftoff timing at a trail edge of a second side of the sheets further comprises the processor executing computer-executable instructions for:

executing a trail edge calibration routine for the N sheets;

for a last M sheets of the N sheets, where M is an integer less than N, the M sheets having TAB liftoff marks on the first sides thereof, measuring a distance between a touchdown mark and the lead edge of each of the M sheets;

determining a minimum value of the measurements;

adjusting a second side trail edge delay value as a function of the minimum value.

16. The system according to claim 15, wherein adjusting TAB liftoff timing at a trail edge of the first side of the sheets further comprises the processor executing computer-executable instructions for:

executing a trail edge calibration routine for the N sheets;

for a last M sheets of the N sheets, where M is an integer less than N, the M sheets having TAB liftoff marks on the second sides thereof, measuring a distance between a touchdown mark and the trail edge of each of the M sheets;

determining a minimum value of the measurements;

adjusting a first side trail edge delay value as a function of the minimum value.

17. The system according to claim 16, wherein adjusting TAB touchdown timing at a lead edge of a second side of the sheets further comprises the processor executing computer-executable instructions for:

executing a lead edge calibration routine for the N sheets;

for a last M sheets of the N sheets, where M is an integer less than N, the M sheets having TAB touchdown marks on the first sides thereof, measuring a distance between a touchdown mark and the lead edge of each of the M sheets;

determining a minimum value of the measurements;

adjusting a second side lead edge delay value as a function of the minimum value.

18. The system according to claim 12, wherein:

the printer prints a plurality of test prints having varied TAB touchdown and liftoff calibrations; and the processor executes computer executable instructions for:

building a non-volatile memory (NVM) table comprising NVM data for each of the TAB calibrations;

storing user input regarding a user-identified test print having a correct calibration, the user input including an identification number for the identified test print;

accessing the NVM data table and reading NVM data used to generate the identified test print;

storing the NVM data into operational NVM locations for future printer use; and deleting the NVM table once the NVM data for the identified test print has been stored to the operational NVM locations.

* * * * *